US011114011B1

(12) United States Patent
Chang et al.

(10) Patent No.: US 11,114,011 B1
(45) Date of Patent: Sep. 7, 2021

(54) DISPLAY DRIVER CIRCUIT FOR HIGH RESOLUTION AND HIGH FRAME RATE AND DISPLAY DEVICE USING THE SAME

(71) Applicant: FocalTech Systems Co., Ltd., Hsinchu (TW)

(72) Inventors: Li-Shen Chang, Hsinchu (TW); Chien-Hsien Lin, Hsinchu (TW); Ko-Ming Su, Hsinchu (TW); Wen-Shian Shie, Hsinchu (TW)

(73) Assignee: FOCALTECH SYSTEMS CO., LTD., Hsinchu (TW)

( * ) Notice: Subject to any disclaimer, the term of this patent is extended or adjusted under 35 U.S.C. 154(b) by 0 days.

(21) Appl. No.: 17/024,287

(22) Filed: Sep. 17, 2020

(30) Foreign Application Priority Data

Jun. 3, 2020 (TW) ..... 109118584

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2320/0276* (2013.01)

(58) Field of Classification Search
CPC ..... G09G 3/20; G09G 2310/027; G09G 2320/0276; G09G 2310/0291
See application file for complete search history.

(56) References Cited

U.S. PATENT DOCUMENTS

2010/0097361 A1 4/2010 Oku
2011/0141098 A1 6/2011 Yaguma et al.
2015/0310812 A1* 10/2015 Chen ..... G09G 3/20 345/691
2018/0005579 A1 1/2018 Brahma et al.
2020/0027387 A1* 1/2020 Cheng ..... G09G 3/20

* cited by examiner

*Primary Examiner* — Andrew Sasinowski
(74) *Attorney, Agent, or Firm* — Muncy, Geissler, Olds & Lowe, P.C.

(57) ABSTRACT

A display driver circuit for high resolution and high frame rate and a display device using the same are provided. A display driver circuit for high resolution and high frame rate includes a GAMMA output circuit, multiple digital-to-analog converters (DACs), multiple source operation amplifiers and at least a pre-charging circuit. The GAMMA output circuit outputs multiple grayscales of GAMMA voltages. Each DAC receives the GAMMA voltages and provides an output data voltage according to display data. Input terminals of the source operation amplifiers correspondingly coupled to output terminals of the DACs receive the corresponding output data voltages. The pre-charging circuit coupled between the input terminal of at least one of the source operation amplifiers and the output terminal of at least one of the DACs pre-charges the input terminal of the coupled source operation amplifier, so that an output terminal of the coupled source operation amplifier has fast response to the received output data voltage.

20 Claims, 9 Drawing Sheets

DISPLAY DRIVER CIRCUIT FOR HIGH RESOLUTION AND HIGH FRAME RATE AND DISPLAY DEVICE USING THE SAME

CROSS-REFERENCE TO RELATED APPLICATIONS

This application claims priority of No. 109118584 filed in Taiwan R.O.C. on Jun. 3, 2020 under 35 USC 119, the entire content of which is hereby incorporated by reference.

BACKGROUND OF THE INVENTION

Field of the Invention

The invention relates to display panel driving technology, and more particularly to a display driver circuit for high resolution and high frame rate and a display device using the same.

Description of the Related Art

FIG. 1 is a schematic view showing a driving principle of a conventional display driver integrated circuit. Referring to FIG. 1, the conventional display driver integrated circuit provides one set of reference voltages in the form of a GAMMA voltage curve to the display driver integrated circuit by the internal (or external) divided voltage of the resistor, and controls the display driver integrated circuit to select the voltages on the GAMMA voltage curve to drive the display device according to display data thereby controlling the brightness (grayscale) of the panel, as shown in FIG. 1.

As resolution and frame rate of panels are getting higher and higher, the charging time requirement on the pixel also becomes more and more severe, and the operation speed of the display driver integrated circuit must be increased therewith. However, the operation speed of the display driver integrated circuit is limited by the speed of the internal analog circuit of the chip.

BRIEF SUMMARY OF THE INVENTION

An objective of the invention is to provide a display driver circuit for high resolution and high frame rate and a display device using the same, wherein an input terminal of a source operation amplifier is pre-charged, so that the source operation amplifier can have fast response to the data voltage in order to increase the driving speed, so that the display driver circuit can be applied to a display panel with higher resolution.

In view of this, the invention provides a display driver circuit for high resolution and high frame rate. The display driver circuit includes a GAMMA output circuit, multiple digital-to-analog converters (DACs), multiple source operation amplifiers and at least one pre-charging circuit. The GAMMA output circuit outputs multiple grayscales of GAMMA voltages. Each DAC includes an output terminal. Each DAC receives the GAMMA voltages, and provides an output data voltage according to display data. Each source operation amplifier includes an input terminal and an output terminal. The input terminals of the source operation amplifiers are correspondingly coupled to the output terminals of the DACs, and receive the corresponding output data voltages. The pre-charging circuit is disposed between the input terminal of at least one of the source operation amplifiers and the output terminal of at least one of the DACs and pre-charges the input terminal of the coupled source operation amplifier, so that the output terminal of the coupled source operation amplifier can have fast response to the received output data voltage.

The invention further provides a display device. The display device includes a display panel and a display driver circuit. The display driver circuit includes a GAMMA output circuit, multiple digital-to-analog converters (DACs), multiple source operation amplifiers and at least one pre-charging circuit. The GAMMA output circuit outputs multiple grayscales of GAMMA voltages. Each DAC includes an output terminal. Each DAC receives the GAMMA voltages, and provides an output data voltage according to display data. Each source operation amplifier includes an input terminal and an output terminal. The input terminals of the source operation amplifiers are correspondingly coupled to the output terminals of the DACs, and receive the corresponding output data voltages. The pre-charging circuit is disposed between the input terminal of at least one of the source operation amplifiers and the output terminal of at least one of the DACs and pre-charges the input terminal of the coupled source operation amplifier, so that the output terminal of the coupled source operation amplifier can have fast response to the received output data voltage.

In the display driver circuit for high resolution and high frame rate and the display device using the same according to the embodiment of the present invention, the pre-charging circuit includes a first switch circuit, a voltage supply circuit and a selection circuit. The first switch circuit is coupled between the input terminal of the source operation amplifier and the output terminal of at least one of the DACs. The voltage supply circuit is to provide multiple voltages. The selection circuit includes multiple input terminals and an output terminal, wherein the input terminals of the selection circuit respectively receive the voltages, and the output terminal of the selection circuit is coupled to the input terminal of the source operation amplifier. Before the DAC provides the corresponding output data voltage, the first switch circuit disconnects the input terminal of the source operation amplifier from the output terminal of the DAC. The selection circuit selects a specific voltage of the voltages, provided by the voltage supply circuit, to be outputted to the input terminal of the source operation amplifier according to a corresponding portion of the display data to perform pre-charging.

In the display driver circuit for high resolution and high frame rate and the display device using the same according to the embodiment of the present invention, the pre-charging circuit includes a buffer circuit, which is coupled between the output terminal of the selection circuit and the input terminal of the source operation amplifier to increase current driving ability and speed up pre-charging. In a preferred embodiment, the pre-charging circuit further includes a second switch circuit which is coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein when pre-charging is finished, the second switch circuit turns off, and the first switch circuit turns on.

In the display driver circuit for high resolution and high frame rate and the display device using the same according to the embodiment of the present invention, the pre-charging circuit includes a first switch circuit, a buffer circuit and a second switch circuit. The first switch circuit is coupled between the input terminal of the source operation amplifier and the output terminal of at least one of the DACs. The buffer circuit is coupled between the input terminal of the source operation amplifier and the output terminal of at least one of the DACs, and performs pre-charging according to the output data voltage outputted from the output terminal of at least one of the DACs. The second switch circuit is coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein the buffer circuit performs pre-charging according to the output data voltage outputted from the output terminal of at least one of the DACs, wherein when pre-charging is finished, the second switch circuit turns off, and the first switch circuit turns on.

In the display driver circuit for high resolution and high frame rate and the display device using the same according to the embodiment of the present invention, the time period in which the pre-charging circuit pre-charges the source operation amplifier includes a predetermined time before the at least one of the DACs provides the corresponding output data voltage. In another preferred embodiment of the present invention, the time period in which the pre-charging circuit pre-charges the source operation amplifier includes a predetermined time after the at least one of the DACs provides the corresponding output data voltage. In the other preferred embodiment of the present invention, the time period in which the pre-charging circuit pre-charges the source operation amplifier comprises a predetermined time before, when and after the at least one of the DACs provides the corresponding output data voltage.

The essence of the invention is to pre-charge the input terminal of the source operation amplifier, and to turn off the front stage of DACs upon charging, so that the time constant seen by the output of the DAC becomes smaller, and the pre-charging circuit can focus on pre-charging. Therefore, the source operation amplifier can have the fast response on the data voltage to increase the driving speed, so that the display driver circuit can be applied to the display panel with the higher resolution.

DETAILED DESCRIPTION OF THE INVENTION

Figure 1:
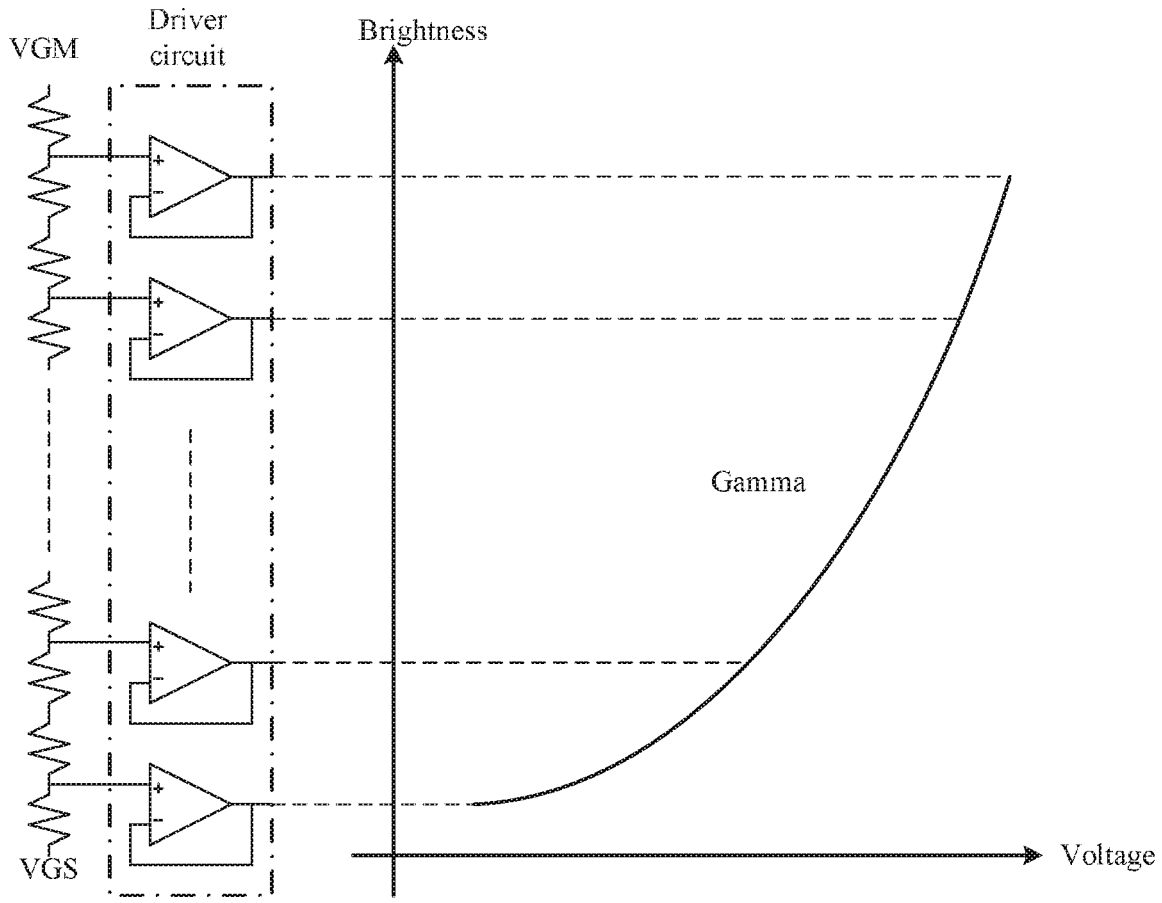
FIG. 1 (Prior Art)
FIG. 1 is a schematic view showing a driving principle of a conventional display driver integrated circuit.
Figure 2:
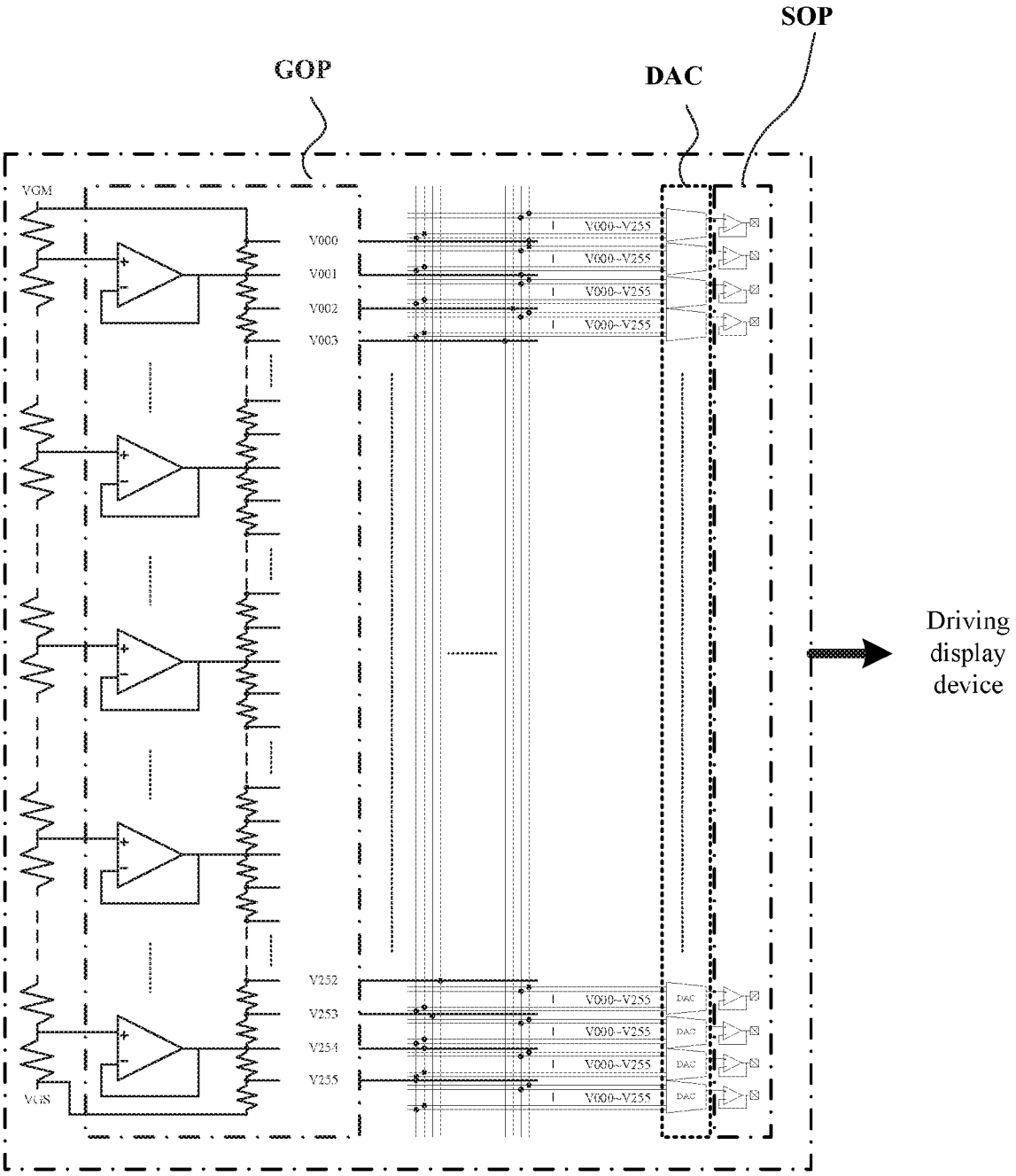
FIG. 2 is a schematic view showing the architecture of a display driver integrated circuit.

FIG. 2 is a schematic view showing the architecture of a display driver integrated circuit. Referring to FIG. 2, the number of source operation amplifiers (SOPs) in the display driver integrated circuit is determined according to resolution of the display device to be driven due to the product property. For example, in a portrait panel with the HD real RGB (1280*720) resolution, the number of data lines is equal to 2,160 (720*3); and in a portrait panel with the FHD real RGB (19201*080) resolution, the number of data lines is equal to 3,240 (1080*3). Based on the consideration of the manufacturing costs, the divided voltage of the resistor in FIG. 2 is transmitted to a huge number of source operation amplifiers SOP through the GAMMA operational amplifier (GOP) to serve as the common reference voltage source, and the digital-to-analog converter (DAC) controlled by the display data determines what voltage should be driven, by each source operation amplifier SOP, to the display device. It can be understood that the source operation amplifier SOP may also be called as a thin film transistor (TFT) source signal amplifier.

Figure 3:
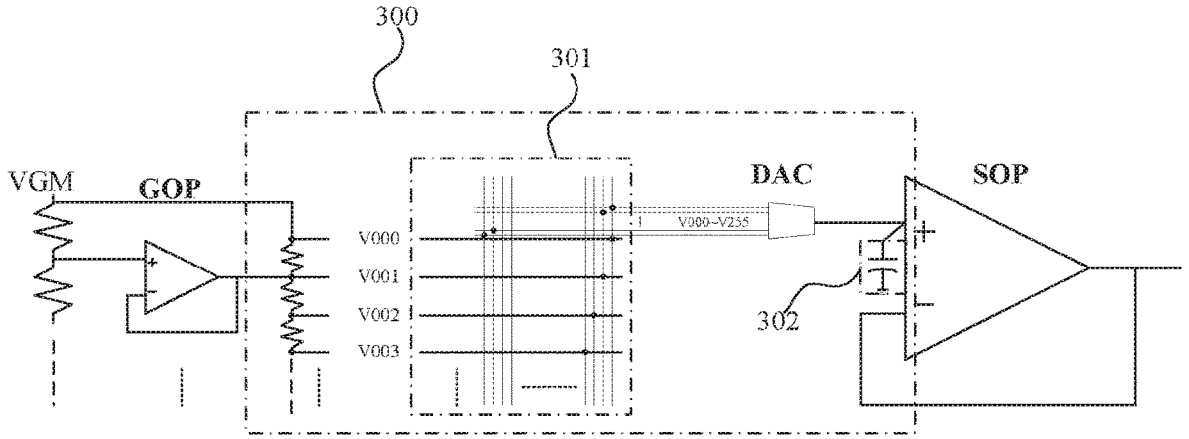
FIG. 3 is a schematic view showing the transmission path of the GAMMA voltage inside the display driver integrated circuit.

FIG. 3 is a schematic view showing the transmission path of the GAMMA voltage inside the display driver integrated circuit. Referring to FIG. 3, symbol 300 refers to the load of the GAMMA operational amplifier GOP; symbol 301 refers to the long wire routing parasitic resistor of the GAMMA voltage (global GAMMA long wire routing); and symbol 302 refers to the parasitic capacitor of the differential input pair of the source operation amplifier SOP. As the processing metal layer used by the display driver integrated circuit becomes thinner and thinner (the impedance of the metal wire is getting higher and higher under the same manufacturing process condition), the ability of the GAMMA operational amplifier GOP for driving the input terminal of the source operation amplifier SOP gradually becomes the main reason for limiting the driving speed. According to the architecture of the display driver integrated circuit shown in FIG. 3, the long wire routing parasitic resistor 301 for transmitting the GAMMA voltage and the parasitic capacitor 302 of the differential input pair of the source operation amplifier SOP inside the display driver integrated circuit gradually dominates the load 300 of the GAMMA operational amplifier GOP. When the load becomes higher, the speed of the input signal of the differential input pair of the source operation amplifier SOP becomes too slow, the slew rate becomes too low, and the driving speed of the display driver integrated circuit is further influenced.

Under the same manufacturing process conditions, the parasitic capacitor 302 of the differential input pair of the source operation amplifier SOP relates to the height dimension of the transistor. Meanwhile, random mismatch of the differential input pair of the source operation amplifier SOP is an important factor for the display quality of the display driver integrated circuit, and the solution of suppressing the random mismatch can be made by enlarging the area of the key component. Thus, it also causes that the parasitic capacitor 302 of the differential input pair of the source operation amplifier SOP cannot be reduced. This condition also causes the key reason that the load 300 seen from the GAMMA operational amplifier GOP cannot be reduced, and further causes the insufficient rising ability of the signal that disables the signal from timely reaching the target voltage under the high-resolution condition.

Figure 4:
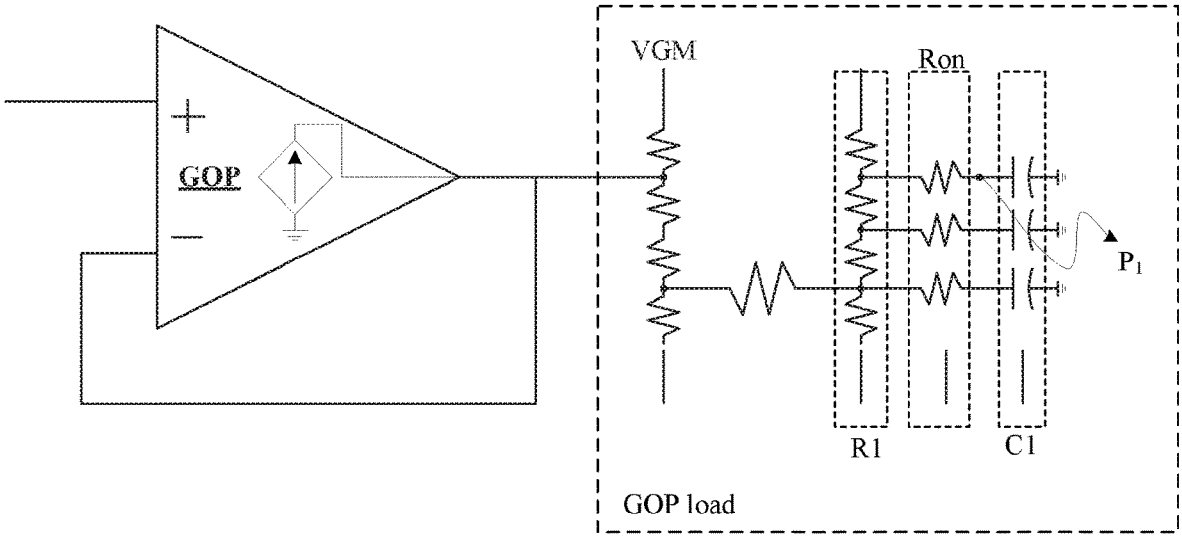
FIG. 4 is a schematic view showing the equivalent circuit of the transmission path of the GAMMA voltage inside the display driver integrated circuit.

In order to make those skilled in the art understand the technology, the schematic view of FIG. 4 shows the equivalent circuit of the transmission path of the GAMMA voltage inside the display driver integrated circuit. Referring to FIG. 4 showing the example, the circuit architecture in FIG. 3 is simplified into the resistor-capacitor model (RC model), where symbol R1 represents the long wire routing parasitic impedance of the GAMMA voltage; symbol Ron represents the transistor's on-resistance of the digital-to-analog converter DAC; and C1 represents the parasitic capacitance of the differential input pair of the source operation amplifier SOP.

According to FIG. 4, those skilled in the art reference can clearly understand that when the parasitic impedance R1 of the long wire routing transmitting the GAMMA voltage is higher and if the parasitic capacitance C1 of the differential input pair of the source operation amplifier SOP is very large, then the influence of the driving power of the GAMMA operational amplifier GOP on the response speed of the node P1 will become smaller. Therefore, under the limited condition of improving the long wire routing parasitic impedance R1 (e.g., considering the manufacturing cost of the display driver integrated circuit), if the response speed of the node P1 needs to be increased, then "the charge/discharge behavior of the node P1" or "the load structure driven by the GAMMA operational amplifier GOP" must be changed.

Figure 5:
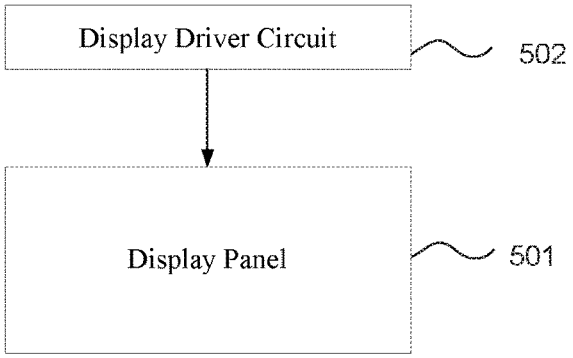
FIG. 5 is a circuit block diagram showing a display device according to a preferred embodiment of the invention.
Figure 6:
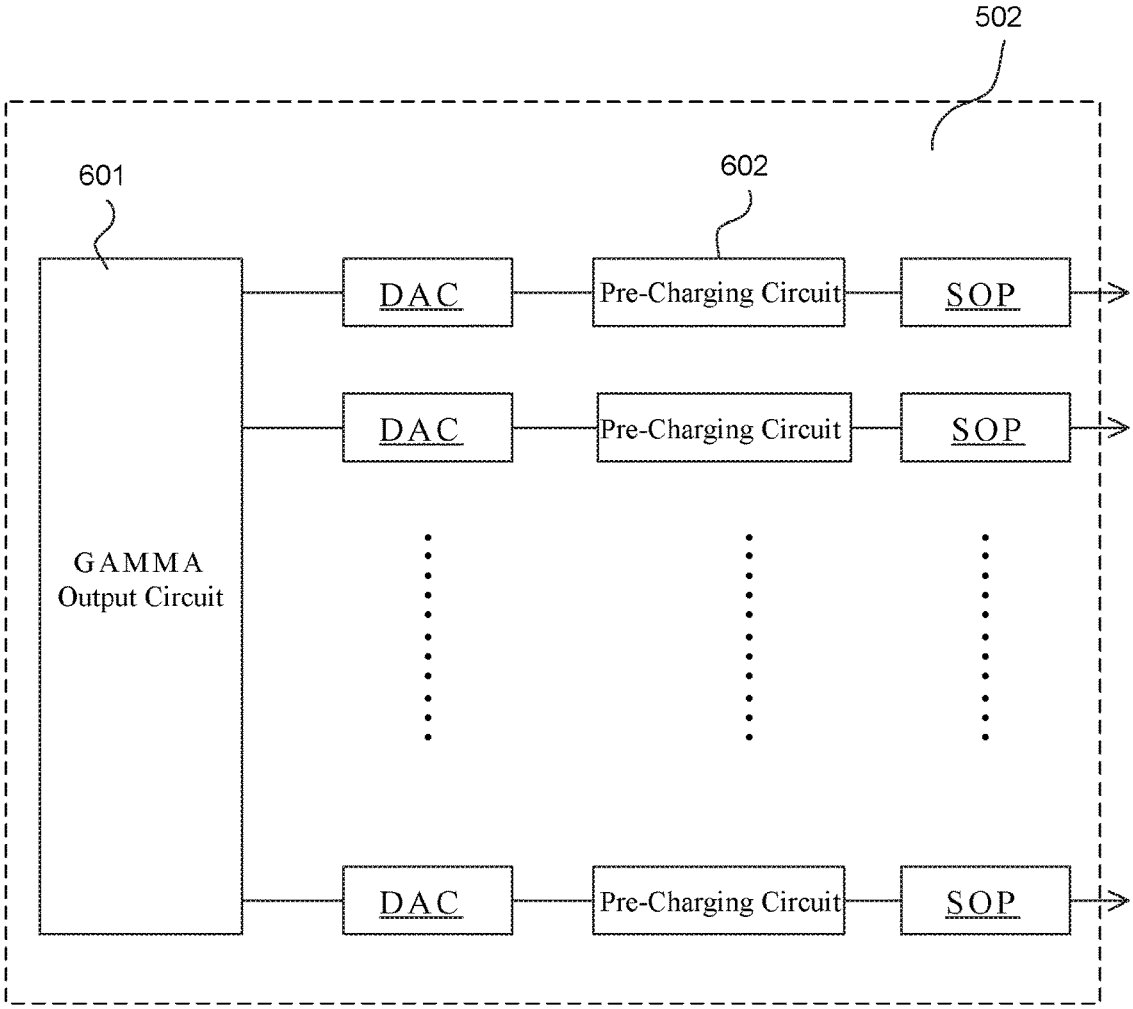
FIG. 6 is a circuit block diagram showing a display driver circuit according to a preferred embodiment of the invention.

FIG. 5 is a circuit block diagram showing a display device according to a preferred embodiment of the present invention. Referring to FIG. 5, the display device includes a display panel 501 and a display driver circuit 502. The display driver circuit 502 is coupled to the display panel 501 and drives the display panel 501. FIG. 6 is a circuit block diagram showing the display driver circuit 502 according to a preferred embodiment of the present invention. Referring to FIG. 6, the display driver circuit 502 includes a GAMMA output circuit 601, multiple digital-to-analog converters DAC, multiple source operation amplifiers SOP and at least a pre-charging circuit 602. In FIG. 6, although there are multiple pre-charging circuits 602, the invention is not limited thereto.

The GAMMA output circuit 601 outputs multiple gray-scales of GAMMA voltages. Each digital-to-analog converter DAC receives the GAMMA voltage outputted by the GAMMA output circuit 601, and provides the output data voltage for the corresponding source operation amplifier SOP according to display data. The input terminal of the source operation amplifier SOP is correspondingly coupled to the output terminal of the digital-to-analog converter DAC to receive the corresponding output data voltage. The pre-charging circuit 602 is coupled between the input terminal of the source operation amplifier SOP and the output terminal of the digital-to-analog converter DAC, and pre-charges the input terminal of the coupled source operation amplifier SOP, so that the output terminal of the coupled source operation amplifier SOP can have the fast response on the received output data voltage.

Figure 7:
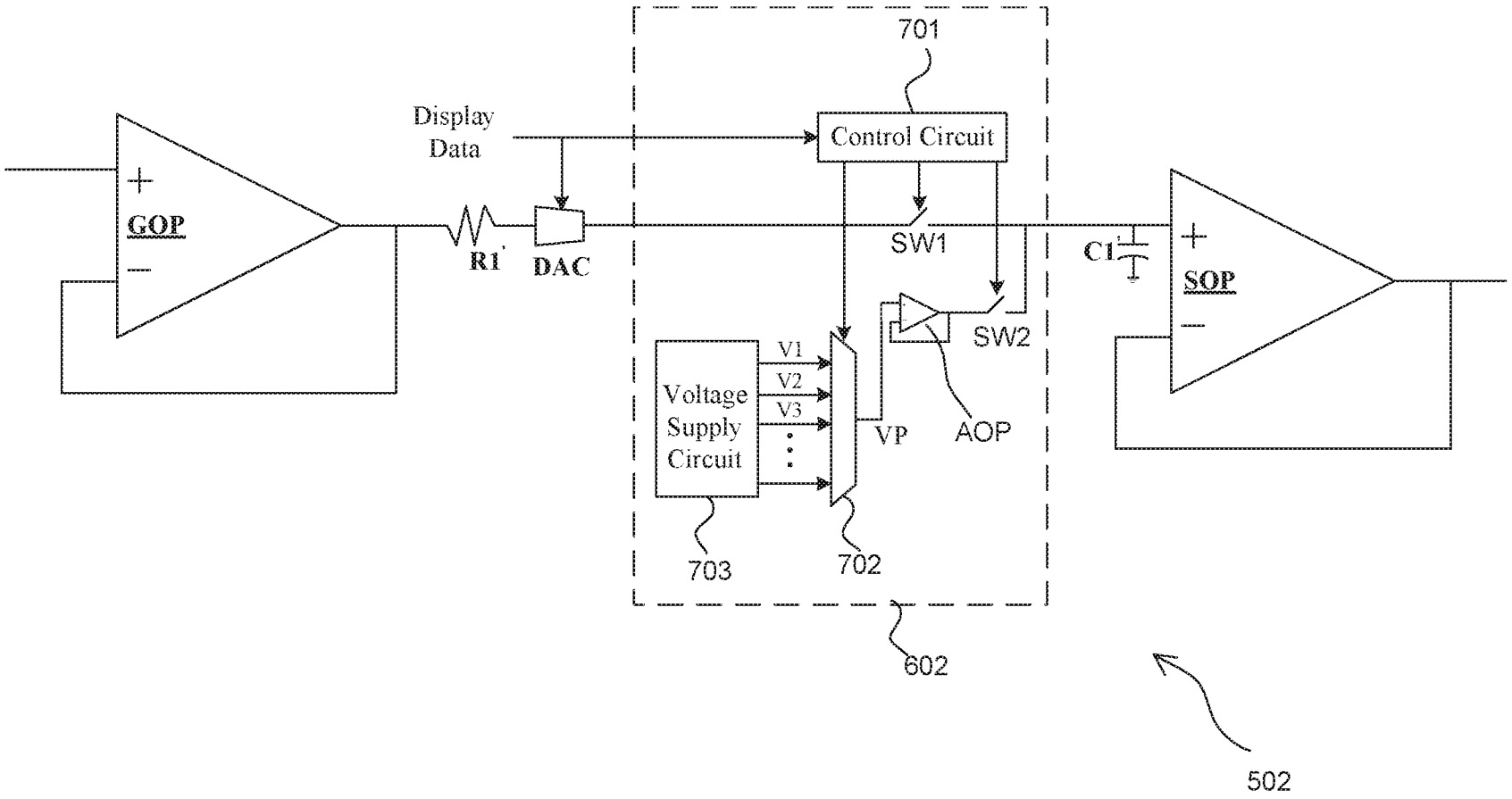
FIG. 7 is a detailed circuit block diagram showing a display driver circuit 502 according to a preferred embodiment of the invention.

FIG. 7 is a detailed circuit block diagram showing a display driver circuit 502 according to a preferred embodiment of the invention. Referring to FIG. 7, in order to understand the present invention more clearly, the original circuit in this embodiment is deliberately simplified, the GAMMA output circuit 601 only shows a portion of the GAMMA operational amplifier GOP, and the impedance of the resistor network portion of the GAMMA output circuit 601 is only denoted by a resistor R1'. In addition, only one set of the digital-to-analog converter DAC and the source operation amplifier SOP are depicted in this embodiment to conveniently explain the essence of the present invention.

In this embodiment, the pre-charging circuit 602 includes a control circuit 701, a first switch circuit SW1, a second switch circuit SW2, a selection circuit 702, an analog buffer circuit AOP and a voltage supply circuit 703. The voltage supply circuit 703 provides multiple voltages V1, V2, V3 . . . . The first switch circuit SW1 is coupled between the positive input terminal of the source operation amplifier SOP and the output terminal of the digital-to-analog converter DAC. The selection circuit 702 includes multiple input terminals and an output terminal. The input terminals of the selection circuit 702 respectively receive the voltages V1, V2, V3 . . . , and the output terminal of the selection circuit 702 is coupled to the positive input terminal of the source operation amplifier SOP through the analog buffer circuit AOP and the second switch circuit SW2.

When the digital-to-analog converter DAC provides the output data voltage, the control circuit 701 controls the first switch circuit SW1 to disconnect the positive input terminal of the source operation amplifier SOP from the output terminal of the digital-to-analog converter DAC. At this time, the load of the output terminal of the GAMMA operational amplifier GOP is only R1', so that the output terminal of the digital-to-analog converter DAC can quickly rise to the output data voltage. In addition, the control circuit 701 controls the second switch circuit SW2 to turn on at the same time (e.g., at the time of turning off the first switch circuit SW1). At this time, the control circuit 701 controls the selection circuit 702 to provide a specific voltage VP similar to the above-mentioned output data voltage, to increase the current driving ability through the analog buffer circuit AOP, and to pre-charge the parasitic capacitor C1' of the positive input terminal of the source operation amplifier SOP. Then, the control circuit 701 controls the first switch circuit SW1 to turn on, and the second switch circuit SW2 to turn off. At this time, the normal operation is recovered. With the above-mentioned pre-charging technology, the response speed of the source operation amplifier SOP to the output data voltage inputted by its input terminal can be increased, and this is beneficial to driving the display panel with the higher resolution or higher frame rate. In an embodiment, the time period in which the pre-charging circuit 602 pre-charges the source operation amplifier SOP may be a predetermined time before the digital-to-analog converter DAC provides the output data voltage, or when the digital-to-analog converter DAC provides the output data voltage, or after the digital-to-analog converter DAC provides the output data voltage; and may also be a predetermined time before, when and after the digital-to-analog converter DAC provides the output data voltage.

According to the explanation of the above-mentioned embodiments, those skilled in the art can understand that if the voltage supply circuit 703 can provide the voltage with the stabler and higher driving ability, then the analog buffer circuit AOP can be omitted. Meanwhile, because the selection circuit 702 itself is a switch network, the second switch circuit SW2 can also be omitted under the circumstance that the analog buffer circuit AOP is not provided. Therefore, the invention is not limited to the above-mentioned circuit.

Figure 8:
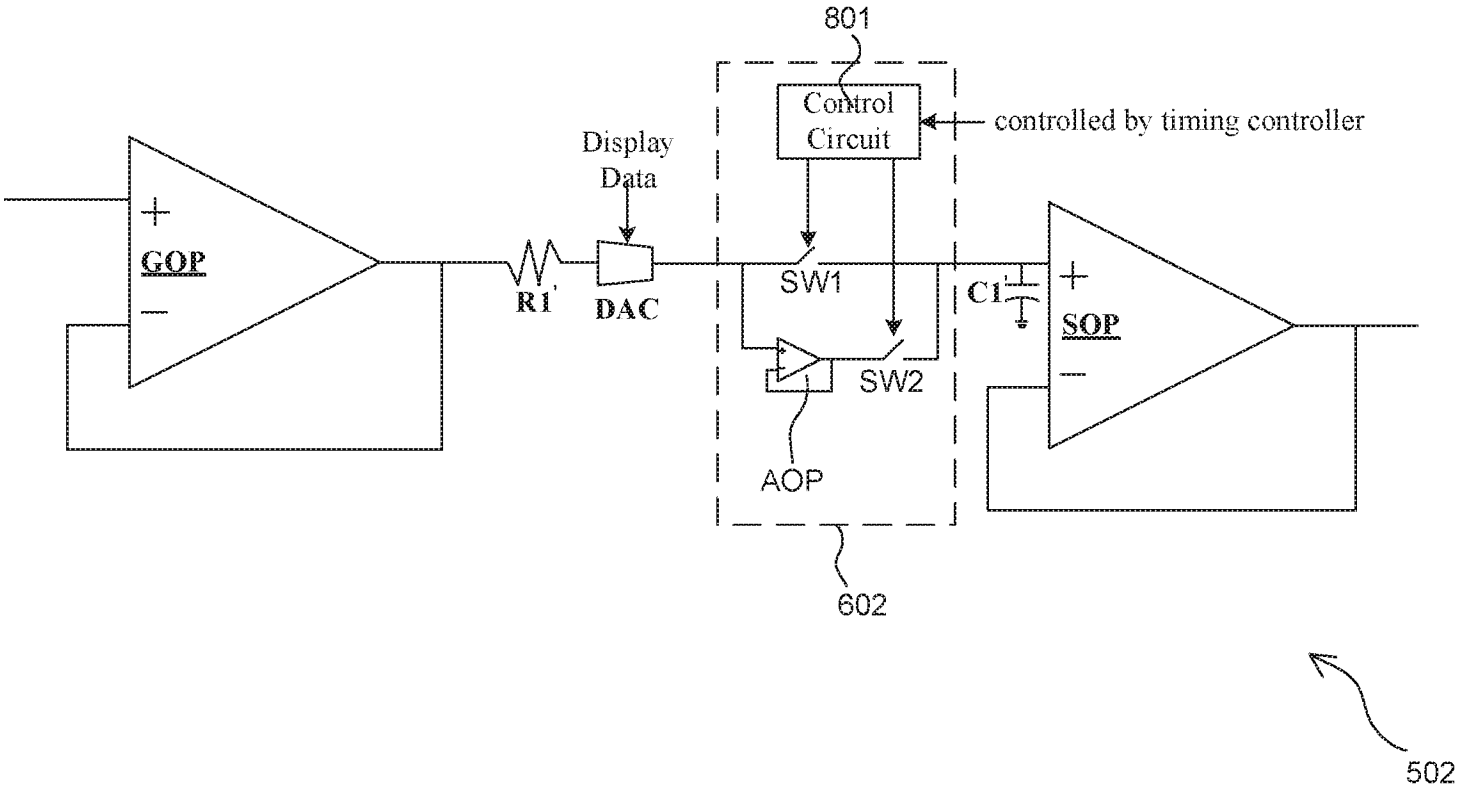
FIG. 8 is a detailed circuit block diagram showing a display driver circuit 502 according to a preferred embodiment of the invention.

FIG. 8 is a detailed circuit block diagram showing a display driver circuit 502 according to a preferred embodiment of the present invention. Referring to FIG. 8, the original circuit in this embodiment is deliberately simplified, the GAMMA output circuit 601 only shows a portion of the GAMMA operational amplifier GOP, and the impedance of the resistor network portion of the GAMMA output circuit 601 is only denoted by a resistor Rt. In addition, only one set of the digital-to-analog converter DAC and the source operation amplifier SOP are depicted in this embodiment to conveniently explain the essence of the invention. Moreover, the difference in this embodiment is that the pre-charging circuit 602 includes a control circuit 801, a first switch circuit SW1, a second switch circuit SW2 and an analog buffer circuit AOP.

When the digital-to-analog converter DAC provides the output data voltage, the control circuit 801 controls the first switch circuit SW1 to disconnect the positive input terminal of the source operation amplifier SOP from the output terminal of the digital-to-analog converter DAC. At this time, the load of the output terminal of the GAMMA operational amplifier GOP is only R1', so that the output terminal of the digital-to-analog converter DAC can quickly rise to the output data voltage. In addition, the control circuit 801 controls the second switch circuit SW2 to turn on at the same time. At this time, the analog buffer circuit AOP rapidly pre-charges the parasitic capacitor C1' of the positive input terminal of the source operation amplifier SOP. Then, the control circuit 801 controls the first switch circuit SW1 to turn on, and the second switch circuit SW2 to turn off. At this time, the normal operation is recovered. With the above-mentioned pre-charging technology, the response speed of the source operation amplifier SOP to the output data voltage inputted by its input terminal can be increased, and this is beneficial to driving the display panel with the higher resolution or higher frame rate. In an embodiment, the time period in which the pre-charging circuit 602 pre-charges the source operation amplifier SOP may be a predetermined time before the digital-to-analog converter DAC provides the output data voltage, or when the digital-to-analog converter DAC provides the output data voltage, or after the digital-to-analog converter DAC provides the output data voltage; and may also be a predetermined time before, when and after the digital-to-analog converter DAC provides the output data voltage. The time period can be can be controlled by the timing controller for example.

Figure 9:
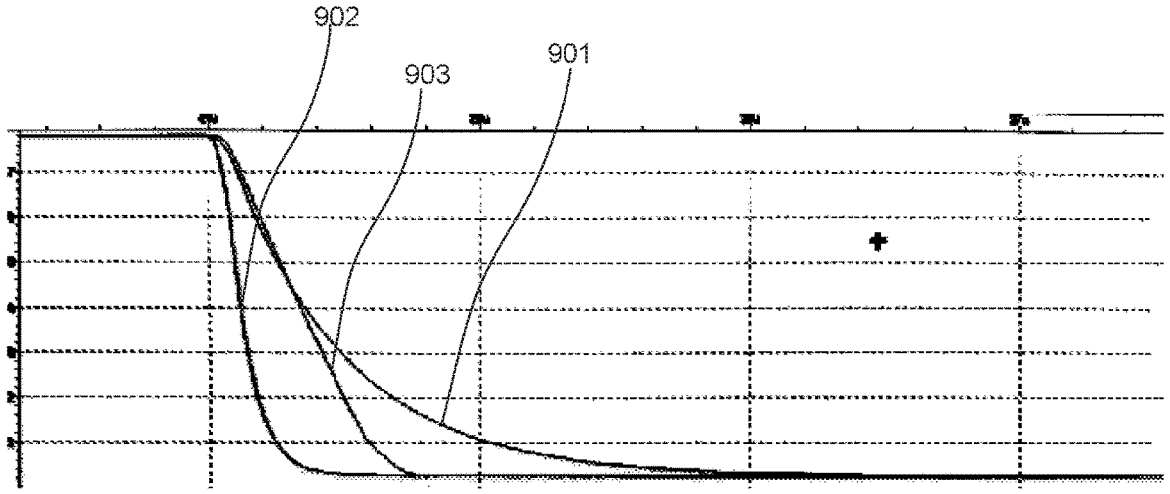
FIGS. 9-12 are a HSPICE simulation diagram showing an operation of a display driver circuit 502 according to a preferred embodiment of the invention.
Figure 10:
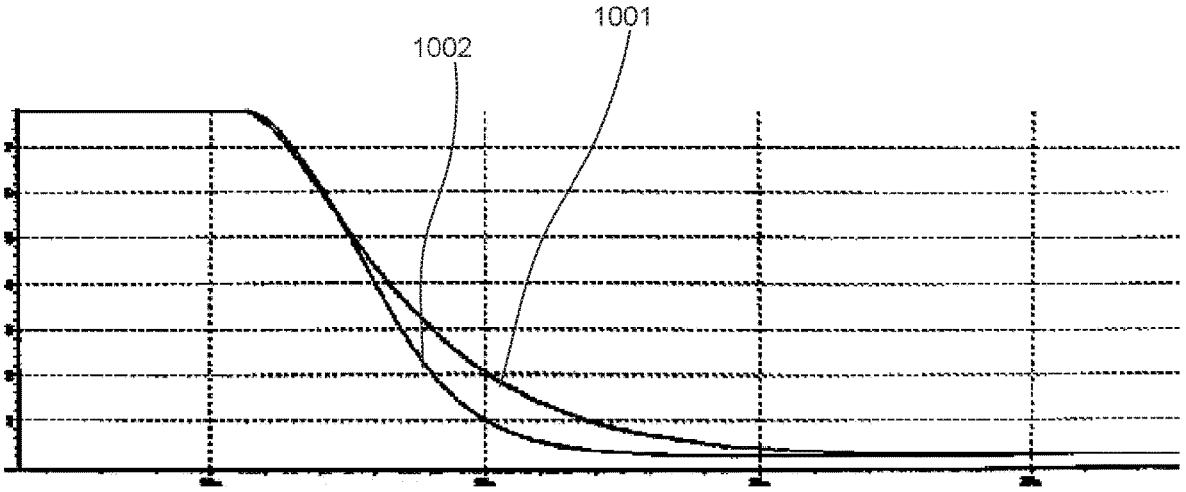

FIGS. 9-12 are a HSPICE simulation diagram showing an operation of a display driver circuit 502 according to a preferred embodiment of the invention. Referring to FIG. 9, the condition of the HSPICE simulation is provided by a panel manufacturer, wherein the load of QHD SOP includes: R_Fanout=7.02841 kΩ, C_Fanout=8.47112 pF, R_ArrayArea=10.1717 kΩ, C_ArrayArea=15.9536 pF. The label 901 is the original discharging waveform without the pre-charging circuit 602. The label 902 is the discharging waveform on the left node of the first switch circuit SW1 with the pre-charging circuit 602 in FIG. 8. The label 903 is the discharging waveform on the right node of the first switch circuit SW1 with the pre-charging circuit 602 in FIG. 8. Referring to FIG. 10, the label 1001 is the waveform depicting the source operation amplifier (SOP) discharging the load without the pre-charging circuit 602. The label 1002 is the waveform depicting the SOP discharging the load with the pre-charging circuit 602. According to FIG. 9-10, the pre-charging circuit 602 can certainly improve the discharging speed.

Figure 11:
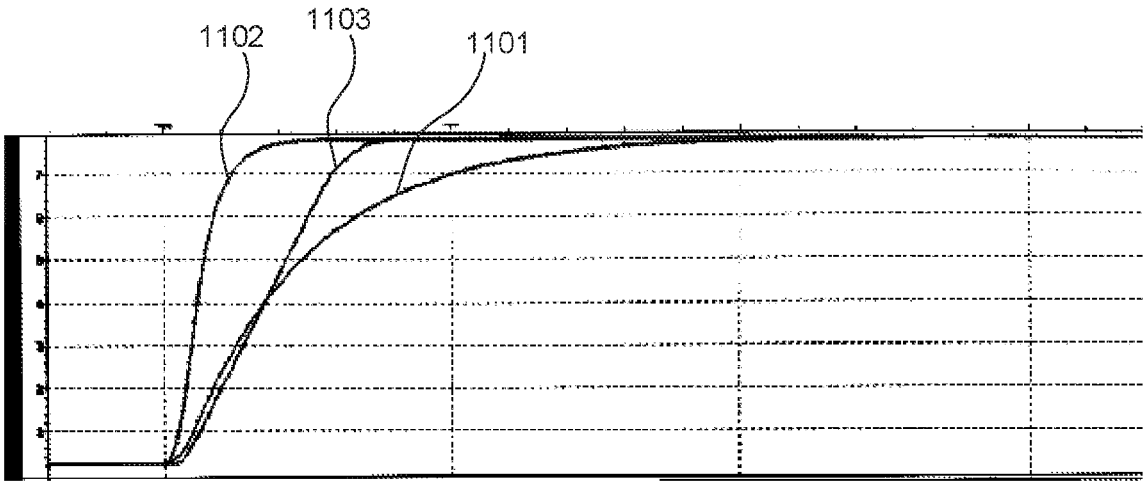
Figure 12:
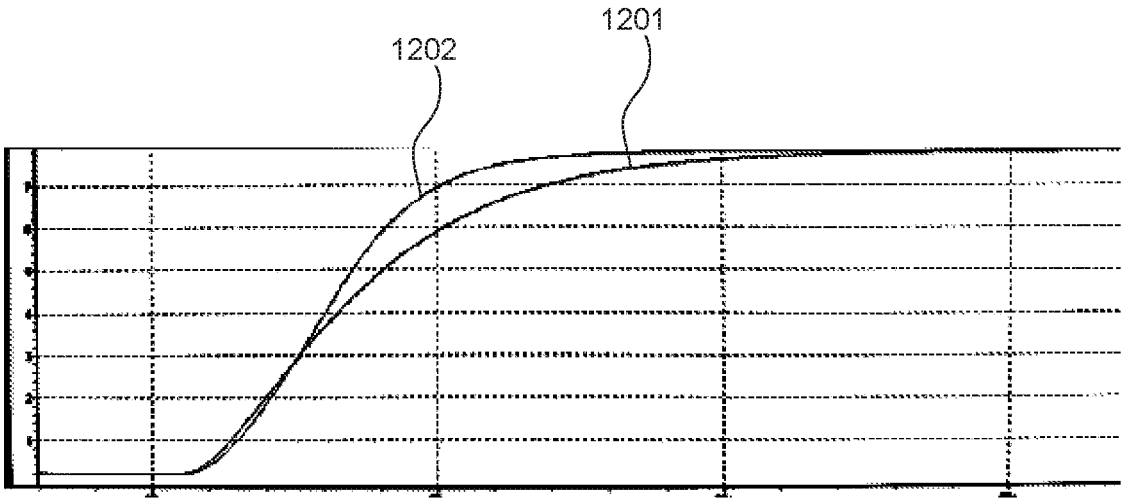

Referring to FIG. 11, The label 1101 is the original charging waveform without the pre-charging circuit 602. The label 1102 is the charging waveform on the left node of the first switch circuit SW1 with the pre-charging circuit 602 in FIG. 8. The label 1103 is the charging waveform on the right node of the first switch circuit SW1 with the pre-charging circuit 602 in FIG. 8. Referring to FIG. 12, the label 1201 is the original waveform depicting the SOP charging the load without the pre-charging circuit 602. The label 1202 is the waveform depicting the SOP charging the load with the pre-charging circuit 602. According to FIG. 11-12, the pre-charging circuit 602 can certainly improve the charging speed.

Furthermore, applicants had performed the charging/discharging speed on HSPICE simulation. The condition of the discharging simulation on HSPICE is from 7.8V to 4V. The original circuit need about 2.227 us. The circuit in the preferred embodiment of the present invention only need 1.216 us. The condition of the charging simulation on HSPICE is from 4V to 7.8V. The original circuit need about 2.210 us. The circuit in the preferred embodiment of the present invention only need 1.232 us. When the condition of the discharging simulation on HSPICE is from 7.8V to 0.2V, the original circuit need about 2.296 us, and the circuit in the preferred embodiment of the present invention only need 1.400 us. When the condition of the charging simulation on HSPICE is from 0.2V to 4V, the original circuit need about 2.225 us, and the circuit in the preferred embodiment of the present invention only need 1.241 us. When the condition of the discharging simulation on HSPICE is from 4V to 0.2V, the original circuit need about 2.318 us, and the circuit in the preferred embodiment of the present invention only need 1.267 us. When the condition of the charging simulation on HSPICE is from 0.2V to 7.8V, the original circuit need about 2.229 us, and the circuit in the preferred embodiment of the present invention only need 1.389 us. According to the simulation above, the present invention can shorten the driving period about 37.7%~45.4%, such that the driving circuit can satisfy the high resolution and high frame rate display product requirement.

In summary, the essence of the invention is to pre-charge the input terminal of the source operation amplifier, and to turn off the front stage of DACs upon charging, so that the time constant seen by the output of the DAC becomes smaller, and the pre-charging circuit can focus on pre-charging. Therefore, the source operation amplifier can have the fast response to the data voltage to increase the driving speed, so that the display driver circuit can be applied to the display panel with the higher resolution.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A display driver circuit for high resolution and high frame rate, comprising:

a GAMMA output circuit outputting multiple grayscales of GAMMA voltages;

multiple digital-to-analog converters (DACs) each comprising an output terminal, wherein the DACs receive the GAMMA voltages and provide output data voltages according to display data;

multiple source operation amplifiers each comprising an input terminal and an output terminal, wherein the input terminals of the source operation amplifiers are correspondingly coupled to the output terminals of the DACs and receive the corresponding output data voltages; and at least a pre-charging circuit which is configured between the input terminal of at least one of the source operation amplifiers and the output terminal of at least one of the DACs, and pre-charges the input terminal of the coupled source operation amplifier, so that the output terminal of the coupled source operation amplifier can have fast response to the received output data voltage;

wherein the pre-charging circuit comprises:

a first switch circuit coupled between the input terminal of the source operation amplifier and the output terminal of at least one of the DACs;

a voltage supply circuit providing multiple voltages; and a selection circuit comprising multiple input terminals and an output terminal, wherein the input terminals of the selection circuit respectively receive the voltages, and the output terminal of the selection circuit is coupled to the input terminal of the source operation amplifier, wherein before the DAC provides the corresponding output data voltage, the first switch circuit disconnects the input terminal of the source operation amplifier from the output terminal of the DAC, wherein the selection circuit selects a specific voltage of the voltages, provided by the voltage supply circuit, to be outputted to the input terminal of the source operation amplifier according to a corresponding portion of the display data to perform pre-charging.

2. The display driver circuit according to claim 1, wherein the pre-charging circuit comprises:

a buffer circuit coupled between the output terminal of the selection circuit and the input terminal of the source operation amplifier to increase current driving ability and speed up pre-charging.

3. The display driver circuit according to claim 2, wherein the pre-charging circuit further comprises:

a second switch circuit coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein when pre-charging is finished, the second switch circuit turns off, and the first switch circuit turns on.

4. The display driver circuit according to claim 1, wherein a time period in which the pre-charging circuit pre-charges the source operation amplifier comprises a predetermined time before the at least one of the DACs provides the corresponding output data voltage.

5. The display driver circuit according to claim 1, wherein a time period in which the pre-charging circuit pre-charges the source operation amplifier comprises a predetermined time after the at least one of the DACs provides the corresponding output data voltage.

6. The display driver circuit according to claim 1, wherein a time period in which the pre-charging circuit pre-charges the source operation amplifier comprises a predetermined time before, when and after the at least one of the DACs provides the corresponding output data voltage.

7. A display driver circuit for high resolution and high frame rate, comprising:

a GAMMA output circuit outputting multiple grayscales of GAMMA voltages;

multiple digital-to-analog converters (DACs) each comprising an output terminal, wherein the DACs receive the GAMMA voltages and provide output data voltages according to display data;

multiple source operation amplifiers each comprising an input terminal and an output terminal, wherein the input terminals of the source operation amplifiers are correspondingly coupled to the output terminals of the DACs and receive the corresponding output data voltages; and at least a pre-charging circuit which is configured between the input terminal of at least one of the source operation amplifiers and the output terminal of at least one of the DACs, and pre-charges the input terminal of the coupled source operation amplifier, so that the output terminal of the coupled source operation amplifier can have fast response to the received output data voltage wherein the pre-charging circuit comprises:

a first switch circuit coupled between the input terminal of the source operation amplifier and the output terminal of at least one of the DACs;

a buffer circuit which is coupled between the input terminal of the source operation amplifier and the output terminal of at least one of the DACs, and performs pre-charging according to the output data voltage outputted from the output terminal of at least one of the DACs; and a second switch circuit coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein the buffer circuit performs pre-charging according to the output data voltage outputted from the output terminal of at least one of the DACs, wherein when pre-charging is finished, the second switch circuit turns off, and the first switch circuit turns on.

8. The display driver circuit according to claim 7, wherein a time period in which the pre-charging circuit pre-charges the source operation amplifier comprises a predetermined time before the at least one of the DACs provides the corresponding output data voltage.

9. The display driver circuit according to claim 7, wherein a time period in which the pre-charging circuit pre-charges the source operation amplifier comprises a predetermined time after the at least one of the DACs provides the corresponding output data voltage.

10. The display driver circuit according to claim 7, wherein a time period in which the pre-charging circuit pre-charges the source operation amplifier comprises a predetermined time before, when and after the at least one of the DACs provides the corresponding output data voltage.

11. A display device, comprising:

a display panel; and a display driver circuit, coupled to the display panel, wherein the display driver circuit comprises:

a GAMMA output circuit outputting multiple grayscales of GAMMA voltages;

multiple digital-to-analog converters (DACs) each comprising an output terminal, wherein the DACs receive the GAMMA voltages and provide output data voltages according to display data;

multiple source operation amplifiers each comprising an input terminal and an output terminal, wherein the input terminals of the source operation amplifiers are correspondingly coupled to the output terminals of the DACs and receive the corresponding output data voltages; and at least a pre-charging circuit which is configured between the input terminal of at least one of the source operation amplifiers and the output terminal of at least one of the DACs, and pre-charges the input terminal of the coupled source operation amplifier, so that the output terminal of the coupled source operation amplifier can have fast response on the received output data voltage;

wherein the pre-charging circuit comprises:

a first switch circuit coupled between the input terminal of the source operation amplifier and the output terminal of at least one of the DACs;

a voltage supply circuit providing multiple voltages; and a selection circuit comprising multiple input terminals and an output terminal, wherein the input terminals of the selection circuit respectively receive the voltages, and the output terminal of the selection circuit is coupled to the input terminal of the source operation amplifier, wherein before the DAC provides the corresponding output data voltage, the first switch circuit disconnects the input terminal of the source operation amplifier from the output terminal of the DAC, wherein the selection circuit selects a specific voltage of the voltages, provided by the voltage supply circuit, to be outputted to the input terminal of the source operation amplifier according to a corresponding portion of the display data to perform pre-charging.

12. The display device according to claim 11, wherein the pre-charging circuit comprises:

a buffer circuit coupled between the output terminal of the selection circuit and the input terminal of the source operation amplifier to increase current driving ability and speed up pre-charging.

13. The display device according to claim 12, wherein the pre-charging circuit further comprises:

a second switch circuit coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein when pre-charging is finished, the second switch circuit turns off, and the first switch circuit turns on.

14. The display device according to claim 11, wherein a time period in which the pre-charging circuit pre-charges the source operation amplifier comprises a predetermined time before the at least one of the DACs provides the corresponding output data voltage.

15. The display device according to claim 11, wherein a time period in which the pre-charging circuit pre-charges the source operation amplifier comprises a predetermined time after the at least one of the DACs provides the corresponding output data voltage.

16. The display device according to claim 11, wherein a time period in which the pre-charging circuit pre-charges the source operation amplifier comprises a predetermined time before, when and after the at least one of the DACs provides the corresponding output data voltage.

17. A display device, comprising:

a display panel; and a display driver circuit, coupled to the display panel, wherein the display driver circuit comprises:

a GAMMA output circuit outputting multiple grayscales of GAMMA voltages;

multiple digital-to-analog converters (DACs) each comprising an output terminal, wherein the DACs receive the GAMMA voltages and provide output data voltages according to display data;

multiple source operation amplifiers each comprising an input terminal and an output terminal, wherein the input terminals of the source operation amplifiers are correspondingly coupled to the output terminals of the DACs and receive the corresponding output data voltages; and at least a pre-charging circuit which is configured between the input terminal of at least one of the source operation amplifiers and the output terminal of at least one of the DACs, and pre-charges the input terminal of the coupled source operation amplifier, so that the output terminal of the coupled source operation amplifier can have fast response on the received output data voltage wherein the pre-charging circuit comprises:

a first switch circuit coupled between the input terminal of the source operation amplifier and the output terminal of at least one of the DACs;

a buffer circuit which is coupled between the input terminal of the source operation amplifier and the output terminal of at least one of the DACs, and performs pre-charging according to the output data voltage outputted from the output terminal of at least one of the DACs; and a second switch circuit coupled between the buffer circuit and the input terminal of the source operation amplifier, wherein before the DAC provides the output data voltage, the first switch circuit disconnects the input terminal of the source operation amplifier from the output terminal of at least one of the DACs, and the second switch circuit turns on, wherein the buffer circuit performs pre-charging according to the output data voltage outputted from the output terminal of at least one of the DACs, wherein when pre-charging is finished, the second switch circuit turns off, and the first switch circuit turns on.

18. The display device according to claim 17, wherein a time period in which the pre-charging circuit pre-charges the source operation amplifier comprises a predetermined time before the at least one of the DACs provides the corresponding output data voltage.

19. The display device according to claim 17, wherein a time period in which the pre-charging circuit pre-charges the source operation amplifier comprises a predetermined time after the at least one of the DACs provides the corresponding output data voltage.

20. The display device according to claim 17, wherein a time period in which the pre-charging circuit pre-charges the source operation amplifier comprises a predetermined time before, when and after the at least one of the DACs provides the corresponding output data voltage.

* * * * *